US007290570B1

(12) United States Patent
Spikes

(10) Patent No.: US 7,290,570 B1
(45) Date of Patent: Nov. 6, 2007

(54) TWIST ATTACHMENT DEVICE

(76) Inventor: Larry W. Spikes, 660 FM 727, Jefferson, TX (US) 75657

( * ) Notice: Subject to any disclaimer, the term of this patent is extended or adjusted under 35 U.S.C. 154(b) by 537 days.

(21) Appl. No.: 10/465,734

(22) Filed: Jun. 19, 2003

Related U.S. Application Data

(60) Provisional application No. 60/463,946, filed on Apr. 21, 2003.

(51) Int. Cl.
*B21F 7/00* (2006.01)
*B21F 9/02* (2006.01)

(52) U.S. Cl. ..... 140/118; 140/93.6

(58) Field of Classification Search ..... 140/57, 140/93.6, 118, 119
See application file for complete search history.

(56) References Cited

U.S. PATENT DOCUMENTS 356,638 A * 1/1887 Haag ..... 140/57
595,623 A * 12/1897 Guthrie ..... 140/57
619,355 A * 2/1899 Scofield ..... 140/57
3,650,302 A * 3/1972 Palms ..... 140/119
4,413,660 A * 11/1983 Conrad ..... 140/119
5,605,181 A * 2/1997 Vuong ..... 140/119

* cited by examiner

*Primary Examiner*—Derris H. Banks
*Assistant Examiner*—Teresa M. Bonk
(74) *Attorney, Agent, or Firm*—R. Keith Harrison

(57) ABSTRACT

A twist attachment device which is suitable for attaching a segment of fence wire such as a run of barbed wire to a fence post in the construction of wire fences. The device includes a frame within which is rotatably mounted a pair of spaced-apart wire twist gears each having a wire notch and a wire segment opening adjacent to the wire notch. A drive mechanism operably engages the wire twist gears to rotate the wire twist gears in the housing. In operation, an attachment wire segment is extended through the registering wire segment openings of the respective wire twist gears, after which a fence post is extended between the spaced-apart wire twist gears. The segment of fence wire to be attached to the fence post is then inserted into the registering wire notches of the wire twist gears. The wire twist gears rotate in concert with each other to wrap the attachment wire segment around the fence wire segment on opposite sides of the fence post, in such a manner that the fence post is interposed between the attachment wire segment and the fence wire segment and the wire segments tightly engage the front and rear sides of the fence post. The drive mechanism for rotating the wire twist gears may be a hand-operated drill or an electric motor, for example.

6 Claims, 6 Drawing Sheets

TWIST ATTACHMENT DEVICE

CROSS-REFERENCE TO RELATED APPLICATIONS

This application claims the benefit of U.S. provisional application No. 60/463,946, filed Apr. 21, 2003.

FIELD OF THE INVENTION

The present invention relates to wire fences such as barbed-wire fences which include runs of wire that are attached to fence posts inserted in the ground. More particularly, the present invention relates to a twist attachment device which is suitable for attaching barbed wire to a fence post by wrapping an attachment wire segment around the barbed wire on opposite sides of the fence post with the fence post interposed between the attachment wire segment and the barbed wire.

BACKGROUND OF THE INVENTION

Barbed wire fences are widely used to define boundaries on land areas for the purpose of keeping livestock or other animals inside the fenced-in areas and keeping predatory animals or unauthorized personnel out of the areas. Typically, a barbed wire fence includes multiple vertically-spaced horizontal runs of barbed wire which are supported at spaced intervals by vertical fence posts extending from the ground. Each of the barbed wire segments is attached to each fence post typically using clips which engage the barbed wire and the fence post. Because these clips must be individually inserted in place on the fence posts, construction of a barbed wire fence is a time-consuming and labor-intensive undertaking.

SUMMARY OF THE INVENTION

The present invention is directed to a twist attachment device which is suitable for attaching a segment of fence wire such as a run of barbed wire to a fence post in the construction of wire fences. The device includes a frame within which is rotatably mounted a pair of spaced-apart wire twist gears each having a wire notch and a wire segment opening adjacent to the wire notch. A drive mechanism operably engages the wire twist gears to rotate the wire twist gears in the housing. In operation, an attachment wire segment is extended through the registering wire segment openings of the respective wire twist gears, after which a fence post is extended between the spaced-apart wire twist gears. The segment of fence wire to be attached to the fence post is then inserted into the registering wire notches of the wire twist gears. The wire twist gears rotate in concert with each other to wrap the attachment wire segment around the fence wire segment on opposite sides of the fence post, in such a manner that the fence post is interposed between the attachment wire segment and the fence wire segment and the wire segments tightly engage the front and rear sides of the fence post. The drive mechanism for rotating the wire twist gears may be a hand-operated drill or an electric motor, for example.

BRIEF DESCRIPTION OF THE DRAWINGS

The invention will be better understood, by way of example, with reference to the accompanying drawings, in which.

DESCRIPTION OF THE PREFERRED EMBODIMENTS

The present invention has particularly beneficial utility in the attachment of fence wires such as segments of barbed wire to fence posts in the construction of wire fences. However, the invention is not so limited in application, and while references may be made to such fence wires and fence posts, the invention is more generally applicable to attaching a wire to a supporting element in a variety of applications.

Figure 5:
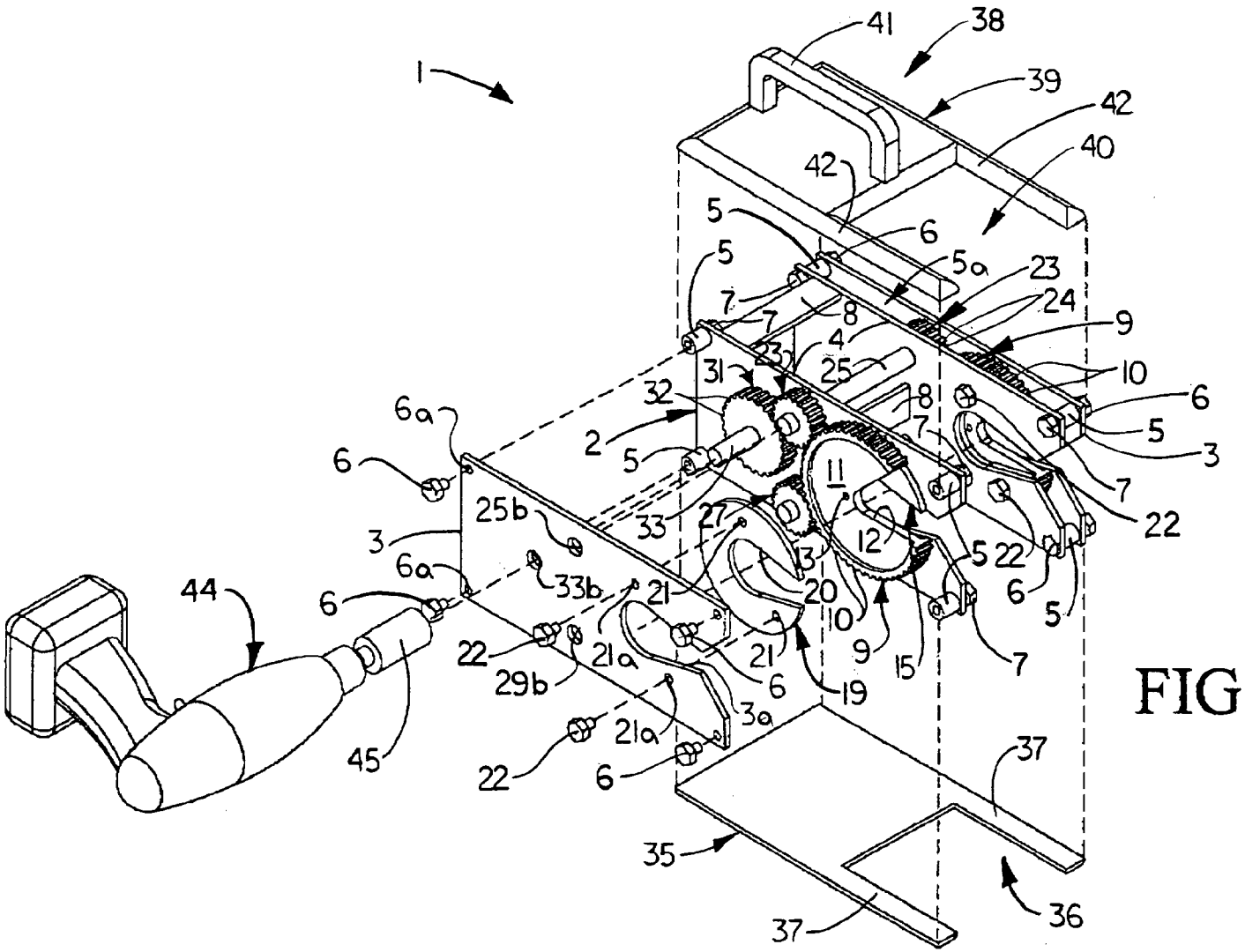
FIG. 5 is an exploded, front perspective view of the twist attachment device.

Referring initially to FIGS. 1, 2 and 5-7 of the drawings, an illustrative embodiment of the twist attachment device of the present invention is generally indicated by reference numeral 1. The twist attachment device 1 includes a frame 2 which includes a pair of generally rectangular inner frame plates 4 disposed in parallel, spaced-apart relationship to each other, as particularly shown in FIGS. 5-7. The inner frame plates 4 may be connected to each other by multiple frame spacers 8 which span the interior surfaces of the inner frame plates 4. An outer frame plate 3 is attached to each inner frame plate 4 typically by multiple plate bolts 6 which extend through respective bolt openings 6*a* provided at respective corners of the outer frame plate 3, through respective plate spacers 5 and bolt openings (not shown) provided in the inner frame plate 4, and threadibly receive respective securing nuts 7. As shown in FIG. 5, the plate spacers 5 define a plate gap 5*a* between each corresponding outer frame plate 3/inner frame plate 4 pair. Alternatively, each outer frame plate 3 may be welded or otherwise attached to the corresponding inner frame plate 4.

Figure 1:
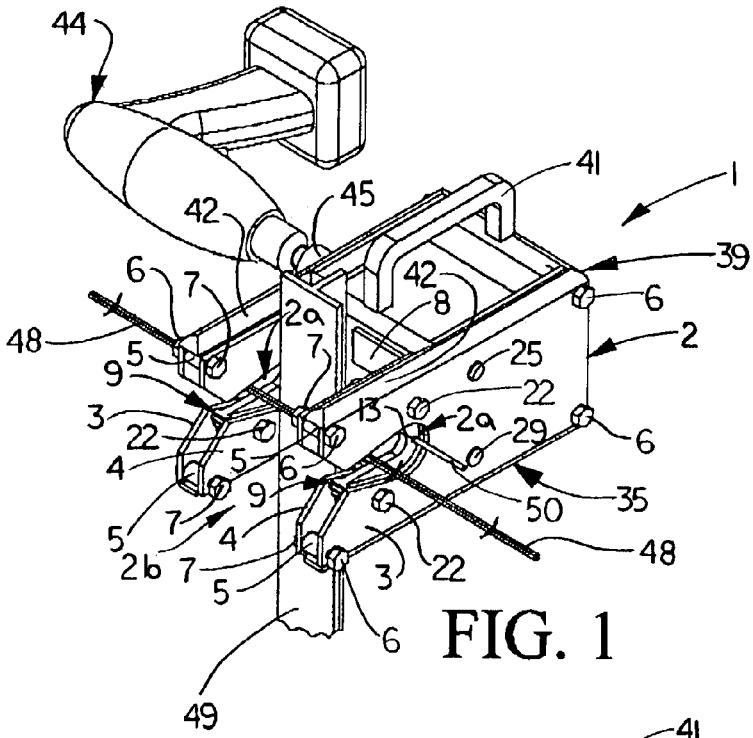
FIG. 1 is a front perspective, left-side view of an illustrative embodiment of the twist attachment device of the present invention, with a hand-operated electric drill operably engaging the device for rotating the wire twist gears thereof.
Figure 2:
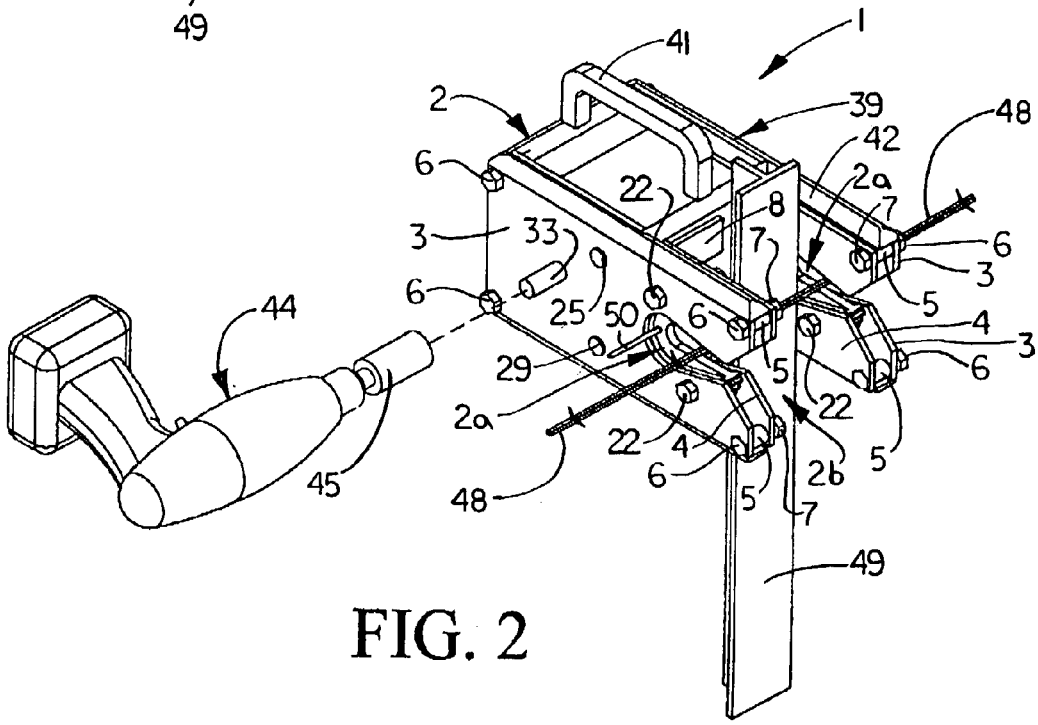
FIG. 2 is a front perspective, right-side view of the twist attachment device of FIG. 1, more particularly illustrating an illustrative technique for providing operable engagement between a hand-operated drill and a drive shaft for the wire twist gears of the device.
Figure 6:
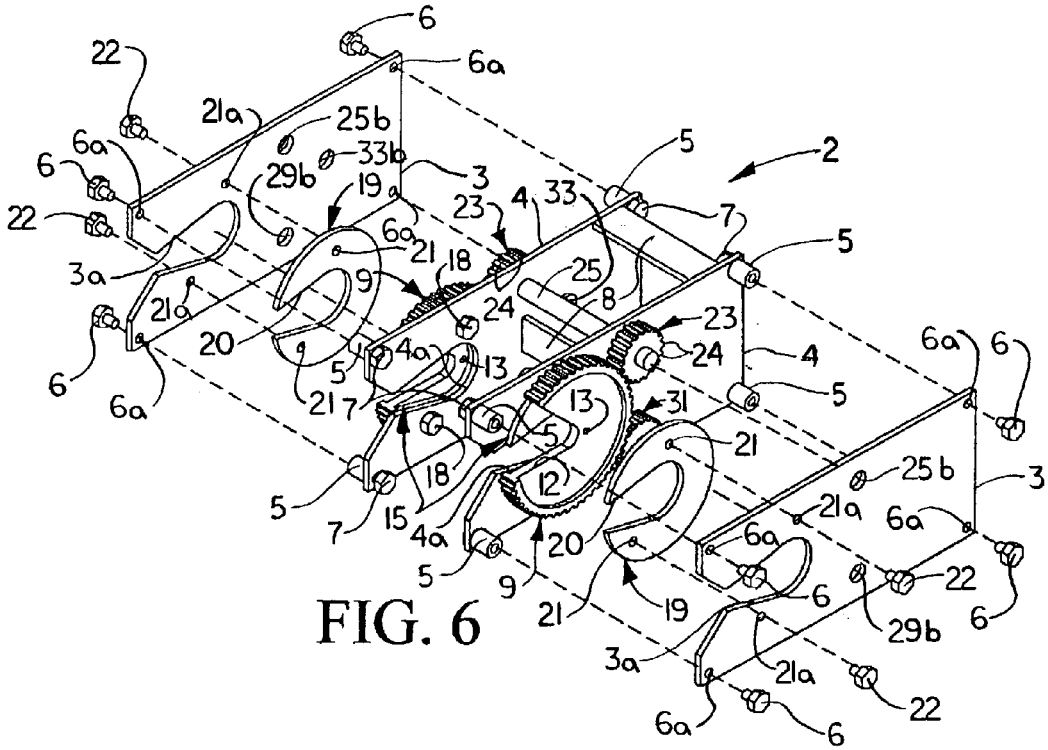
FIG. 6 is an exploded, front perspective view of an illustrative frame element and gear assembly of the twist attachment device.
Figure 7:
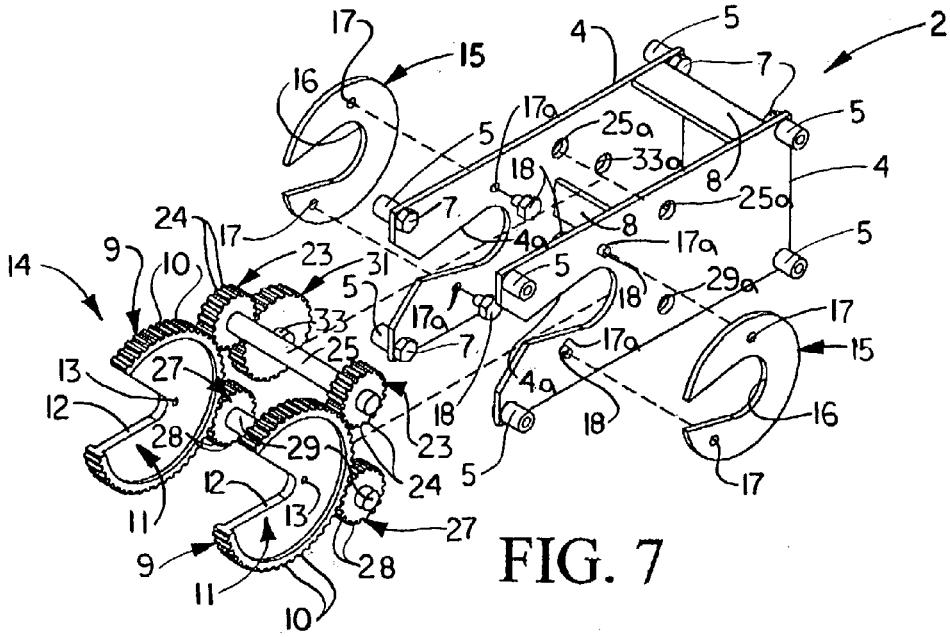
FIG. 7 is an exploded, front perspective view of the frame element of the twist attachment device, more particularly illustrating an illustrative gear assembly for the device in exploded view.

As shown in FIG. 7, an elongated inner frame plate notch 4*a* extends into the front edge of each inner frame plate 4. As shown in FIG. 6, an outer frame plate notch 3*a* of like size and shape extends into the front edge of each outer frame plate 3. Accordingly, the inner frame plate notch 4*a* and the outer frame plate notch 3*a* of each inner frame plate 4/outer frame plate 3 pair are disposed in registering relationship to each other and, as shown in FIGS. 1 and 2, together define a corresponding frame plate notch 2*a* in the assembled frame 2. As shown in FIG. 7, a generally crescent-shaped inner bearing plate 15, having an elongated plate notch 16, is mounted on the outer surface of each inner frame plate 4 in the corresponding plate gap 5*a* (FIG. 5) of each inner frame plate 4/outer frame plate 3 pair. Typically, a pair of plate mount screws 18 is threaded outwardly through respective mount screw openings 17*a* in the corresponding inner frame plate 4 and through registering plate mount screw openings 17 in the corresponding inner bearing plate 15. As shown in FIG. 6, a generally crescent-shaped outer bearing plate 19 having an elongated plate notch 20 is likewise mounted on the inner surface of each outer frame plate 3 in the corresponding plate gap 5*a*, in spaced-apart relationship to the inner bearing plate 15. A pair of plate mount screws 22 is threaded inwardly through respective plate mount screw openings 21*a* in the corresponding outer frame plate 3 and through registering plate mount screw openings 21 in the corresponding outer bearing plate 19. The plate notch 16 of each inner bearing plate 15 and the plate notch 20 of each outer bearing plate 19 are disposed in registering relationship to the outer frame plate notch 3*a* of the outer frame plate 3 and the inner frame plate notch 4*a* of the inner frame plate 4 on the corresponding side of the frame 2. Thus, the plate notch 16 of the inner bearing plate 15 and the plate notch 20 of the outer bearing plate 19 further define the frame notch 2*a* on the corresponding side of the frame 2.

As further shown in FIG. 7, the twist attachment device 1 has a gear assembly 14 which includes a pair of spaced-apart wire twist gears 9, each of which is rotatably mounted between the corresponding inner bearing plate 15/outer bearing plate 19 pair in the corresponding plate gap 5*a* of the frame 2, in the manner hereinafter described. Each wire twist gear 9 has exterior gear teeth 10, a gear depression 11 in both surfaces, and a generally V-shaped wire notch 12. A wire opening 13 extends through or is otherwise provided in each wire twist gear 9, typically adjacent to the apex of the wire notch 12. As shown in FIG. 5, the gear depressions 11 of each wire twist gear 9 slidably accommodate the respective inner bearing plate 15 and outer bearing plate 19 of each corresponding inner bearing plate 15/outer bearing plate 19 pair. Accordingly, each wire twist gear 9 is rotatably mounted between the corresponding inner bearing plate 15/outer bearing plate 19 pair in the corresponding plate gap 5*a* of the frame 2. It is understood that the inner bearing plate 15 and the outer bearing plate 19 represent only one example of a suitable mechanism for rotatably mounting the respective wire twist gears 9 on the frame 2, and each wire twist gear 9 may be rotatably mounted in the corresponding plate gap 5*a* using alternative techniques known by those skilled in the art.

As further shown in FIG. 7, the gear assembly 14 further includes a pair of spaced-apart upper transfer gears 23 each having gear teeth 24 and mounted on a common upper transfer gear shaft 25, and a pair of spaced-apart lower transfer gears 27 each having gear teeth 28 and mounted on a common lower transfer gear shaft 29. The upper transfer gear shaft 25 is rotatably mounted in an inner upper gear rod opening 25*a* (FIG. 7) and a registering outer upper gear rod opening 25*b* (FIG. 6) provided in each inner frame plate 4 and outer frame plate 3, respectively. In like manner, the lower transfer gear shaft 29 is rotatably mounted in an inner lower gear rod opening 29*a* (FIG. 7) and a registering outer lower gear rod opening 29*b* (FIG. 6) provided in each inner frame plate 4 and outer frame plate 3, respectively. As shown in FIG. 5, like each of the wire twist gears 9, each of the upper transfer gears 23 and each of the lower transfer gears 27 is mounted in the corresponding plate gap 5*a* of the frame 2. Accordingly, both the gear teeth 24 of the upper transfer gear 23 and the gear teeth 28 of the lower transfer gear 27 in each plate gap 5*a* mesh with the gear teeth 10 of the corresponding wire twist gear 9 mounted in the same plate gap 5*a*.

As shown in FIG. 7, the gear assembly 14 further includes a drive gear 31 which is operable to rotate the wire twist gears 9 through the upper transfer gears 23 and the lower transfer gears 27, as hereinafter described. The drive gear 31 has gear teeth 32 and is rotatably mounted in one of the plate gaps 5*a*, on a drive shaft 33 which is rotatably mounted in an inner drive shaft opening 33*a* (FIG. 7) provided in one of the inner frame plates 4 and a registering outer drive shaft opening 33*b* (FIGS. 5 and 6) provided in the adjacent outer frame plate 3. The gear teeth 32 of the drive gear 31 mesh with both the gear teeth 24 of the upper transfer gear 23 and the gear teeth 28 of the lower transfer gear 27 rotatably mounted in the same plate gap 5*a*. As shown in FIG. 2, the drive shaft 33 extends beyond the outer surface of the outer frame plate 3 of the frame 2. As shown in FIG. 5, in operation of the twist attachment device 1 as hereinafter described, a drill chuck 45 of a hand-held electric drill 44 may engage the protruding portion of the drive shaft 33 to rotate the drive shaft 33 and drive gear 31. The drive gear 31, in turn, rotates both the upper transfer gear shaft 25 and the lower transfer gear shaft 29 through the respective upper transfer gear 23 and the lower transfer gear 27 which mesh with the drive gear 31 in the same plate gap 5*a*. The upper transfer gears 23 and the lower transfer gears 27, in turn, rotate the respective wire twist gears 9 such that the wire notch 12 of each wire twist gear 9 repeatedly traverses the corresponding frame notch 2*a* (FIGS. 1 and 2) defined by the inner frame plate notch 4*a* and the outer frame plate notch 3*a* of the corresponding inner frame plate 4/outer frame plate 3 pair. It is understood that the gear assembly 14 heretofore described represents only one example of a gear arrangement which may be used to transmit driving rotation from a drill 44 or other powering device to the wire twist gears 9 and that those skilled in the art will recognize other arrangements for such driving rotation transmission. For example, the drill 44 may be directly coupled to the wire twist gears 9 or may be indirectly coupled to the wire twist gears 9 through any number of intermediary gears, as desired. Those skilled in the art will further recognize that the housing 2 may have alternative designs which depart from that heretofore described and having both the inner frame plates 4 and the outer frame plates 3. For example, the various components of the gear assembly 14 may be rotatably mounted on the respective inner frame plates 4 or equivalents thereof while the outer frame plates 3 are either omitted or an equivalent structure for the outer frame plates 3 is provided on each inner frame plate 4 for reinforcing the gear assembly 14 in the frame 2 and/or housing the various components of the gear assembly 14.

As shown in FIG. 5, a housing 38 may be provided on the frame 2 to cover the plate gaps 5*a*. The housing 38 may include a top housing plate 39, typically having a handle 41, may be provided on the top of the frame 2. The top housing plate 39 may include a pair of forwardly-extending plate arms 42 which cover the wire twist gears 9 and the upper transfer gears 23 in the respective plate gaps 5*a* of the frame 2. A plate notch 40 is defined between the parallel plate arms 42. The housing 38 may further include a bottom housing plate 35, having a pair of forwardly-extending, parallel plate arms 37 that define a plate notch 36, may be provided on the bottom of the frame 2. Accordingly, as shown in FIGS. 1 and 2, a frame space 2*b* is defined by the plate notch 40 of the top housing plate 39 and the plate notch 36 of the bottom housing plate 35, between the inner frame plates 4 of the frame 2. It will be recognized by those skilled in the art that the housing 38 may have various alternative configurations which are suitable for covering the plate gaps 5*a* in the frame 2, the top housing plate 39 and bottom housing plate 35 heretofore described being one example of a housing which is suitable for the purpose.

Figure 3:
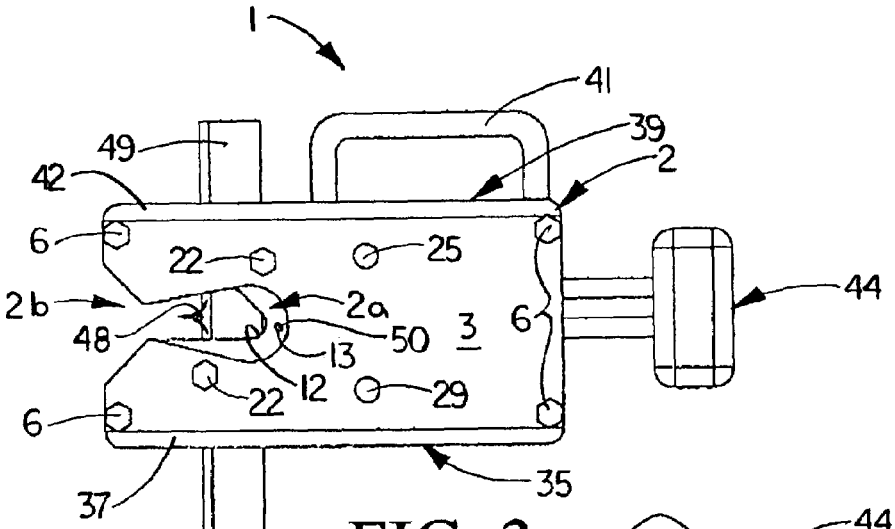
FIG. 3 is a left side view of the twist attachment device, with an attachment wire segment and a fence wire segment suitably positioned in the device preparatory to operation of the device.
Figure 4:
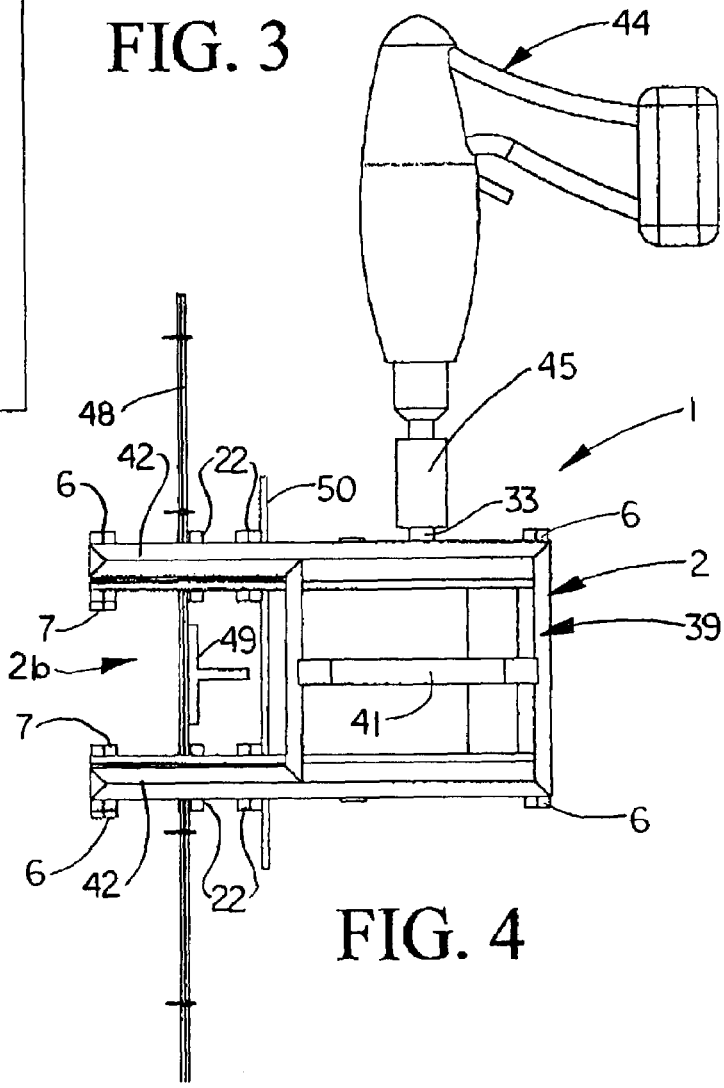
FIG. 4 is a top view of the twist attachment device of FIG. 3, illustrating relative positions of the attachment wire segment, the fence post and the fence wire segment preparatory to operation of the device.
Figure 8:
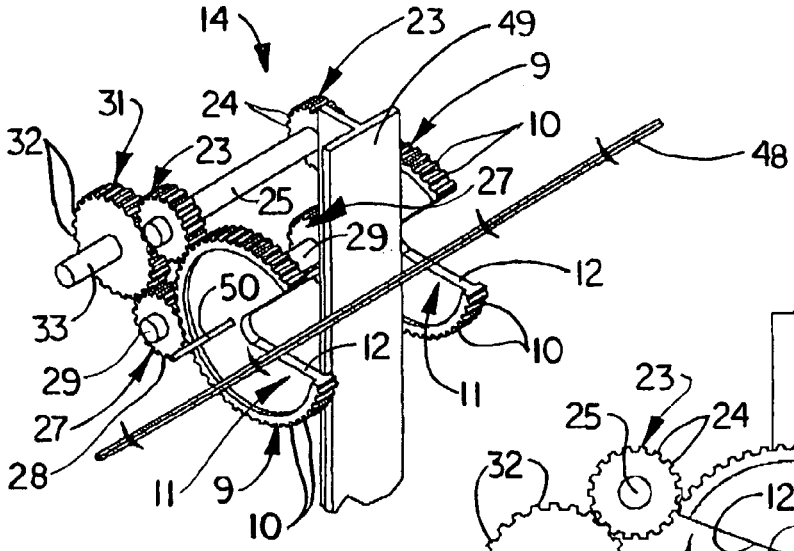
FIG. 8 is a front perspective view of an illustrative gear assembly, removed from the frame element of the twist attachment device for clarity, with an attachment wire segment and a fence wire segment suitably positioned with respect to a fence post preparatory to attaching the fence wire segment to the fence post.

Referring next to FIGS. 1-4 and FIGS. 8-10 of the drawings, in typical application of the twist attachment device 1, a horizontal run of fence wire 48 is attached to a vertical fence post 49 using an attachment wire segment 50. While the fence wire 48 shown in the drawings is barbed wire used in the construction of a barbed wire fence, it is understood that the invention may be used in other applications in which it is desired to secure a wire to a support. Accordingly, the wire notches 12 of the respective wire twist gears 9 of the twist attachment device 1 are initially positioned in generally registering relationship with respect to the frame notches 2*a* of the frame 2, as shown in FIG. 3. This is accomplished by inserting the protruding drive shaft 33 into the chuck 45 of the electric drill 44, as shown in FIG. 2, and then operating the drill 44 to rotate the drive shaft 33 and thus, the drive gear 31, the upper transfer gears 23, the lower transfer gears 27 and the respective wire twist gears 9, respectively, until the wire notches 12 rotate around to generally align with the respective frame notches 2*a*, shown in FIG. 3. Next, the attachment wire segment 50 is extended through the registering wire openings 13 of the respective wire twist gears 9, with the attachment wire segment 50 also extending through both frame notches 2*a* of the frame 2, as shown in FIGS. 1 and 2, and through the frame space 2*b* of the frame 2, as shown in FIG. 4. The frame 2 is then positioned in such a manner that the fence post 49 is located between the inner surfaces of the inner frame plates 4 within the frame space 2*b*, as further shown in FIG. 4. Next, the length of fence wire 48 to be attached to the fence post 49 is inserted into the two spaced-apart frame notches 2*a* and through the frame space 2*b* of the frame 2. Accordingly, as shown in FIGS. 4 and 8, the segment of fence wire 48 and the attachment wire segment 50 are positioned on opposite sides of the fence post 49. As shown in FIG. 2, the drive shaft 33 of the twist attachment device 1 remains inserted into the chuck 45 of the electric drill 44.

Figure 9:
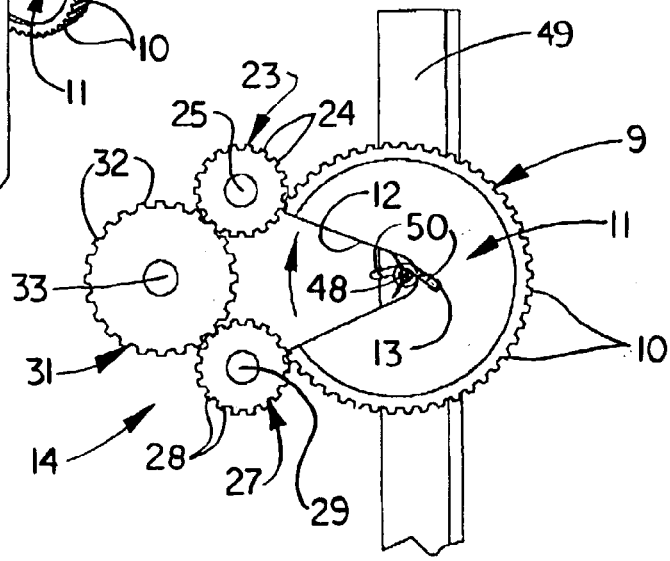
FIG. 9 is a side view of the illustrative gear assembly of the twist attachment device, more particularly illustrating wrapping of the attachment wire segment around the fence wire segment on respective sides of the fence post to attach the fence wire segment to the fence post.

As the drill 44 is operated to rotate the drive shaft 33 and drive gear 31, the drive gear 31 in turn rotates both the meshing upper transfer gear 23 and lower transfer gear 27 which are rotatably mounted in the same plate gap 5*a* of the frame 2 as the drive gear 31, as heretofore described with respect to FIG. 5 and as shown in FIG. 9. Accordingly, both of the upper transfer gears 23 on the upper transfer gear shaft 25 and both of the lower transfer gears 27 on the lower transfer gear shaft 29 are simultaneously rotated by the drive gear 31. Both the upper transfer gear 23 and the lower transfer gear 27 in each plate gap 5*a* of the frame 2 therefore rotate the corresponding meshing wire twist gear 9 in the same plate gap 5*a*. Consequently, when the wire notch 12 of the wire twist gear 9 rotates around to the corresponding lower transfer gear 27, as shown in FIG. 9, the lower transfer gear 27 drivingly disengages the wire twist gear 9. Simultaneously, the gear teeth 24 of the upper transfer gear 23 continue to mesh with the gear teeth 10 of the wire twist gear 9 and rotate the wire twist gear 9 in the plate gap 5*a* of the frame 2 until the wire notch 12 clears the lower transfer gear 27 and the gear teeth 28 of the lower transfer gear 27 again mesh with the gear teeth 10 of the wire twist gear 9. In similar manner, when the wire notch 12 of the wire twist gear 9 next rotates around to the corresponding upper transfer gear 23, as further shown in FIG. 9, the upper transfer gear 23 drivingly disengages the wire twist gear 9. Simultaneously, the gear teeth 28 of the lower transfer gear 27 continue to mesh with the gear teeth 10 of the wire twist gear 9 and rotate the wire twist gear 9 in the plate gap 5*a* of the frame 2 as the wire notch 12 clears the upper transfer gear 23 and the gear teeth 24 of the upper transfer gear 23 again mesh with the gear teeth 10 of the wire twist gear 9. In the foregoing manner, each upper transfer gear 23 and each lower transfer gear 27 in the plate gap 5*a* on the corresponding side of the frame 2 is operable to continuously rotate the corresponding wire twist gear 9 without interruption by the wire notch 12. Furthermore, because the upper transfer gears 23 are mounted on a common upper transfer gear shaft 25 and the lower transfer gears 27 are mounted on a common lower transfer gear shaft 29, both of the upper transfer gears 23 rotate in tandem with each other in the respective plate gaps 5*a* and both of the lower transfer gears 27 rotate in tandem with each other in the respective plate gaps 5*a*. Consequently, the wire notches 12 of the respective wire twist gears 9 remain aligned with each other as the wire twist gears 9 are rotated in tandem with each other in the respective plate gaps 5*a* of the frame 2.

Figure 10:
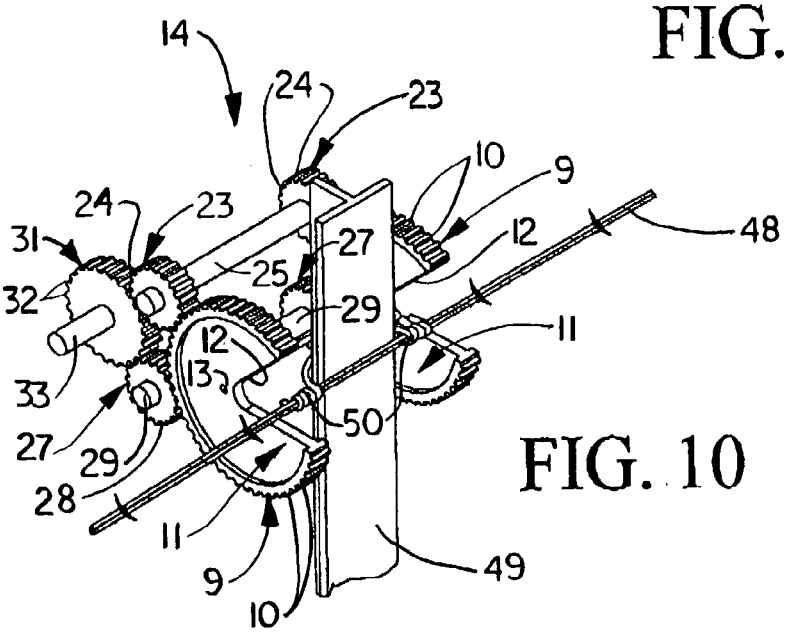
FIG. 10 is a front perspective view of the illustrative gear assembly of the twist attachment device, illustrating the attachment wire segment wrapped around the fence wire segment on respective sides of the fence post upon completion of the twist-attachment operation using the device.

As the wire twist gears 9 are rotated in the respective plate gaps 5*a* of the frame 2 in the manner heretofore described and as shown in FIG. 9, the fence wire 48 is situated at the apex of each wire notch 12, which apex is typically located at substantially the center of the corresponding wire twist gear 9. The attachment wire segment 50, on the other hand, extends through the wire opening 13, which is off-center with respect to the apex of the wire notch 12 in the corresponding wire twist gear 9. Consequently, each time the wire twist gears 9 complete a full revolution in the respective plate gaps 5*a* of the frame 2, the fence wire 48 remains stationary while the attachment wire segment 50 is wrapped completely around the fence wire 48, as shown in FIG. 9, on both sides of the fence post 49, as shown in FIG. 10. After continued rotation of the wire twist gears 9, the ends of the shortening attachment wire segment 50 eventually pull out of the wire openings 13 of the respective wire twist gears 9, at which point the wire segment 50 has become wrapped around the fence wire 48 several times on each side of the fence post 49, as shown in FIG. 10. Accordingly, the fence post 49 is held tightly between the attachment wire segment 50 on one side and the fence wire 48 on the other, and the fence wire 48 is therefore securely mounted on the fence post 49. At that point, the wire twist gears 9 are rotated around to again register the wire notches 12 with the respective frame notches 2*a* in the frame 2, after which the frame 2 is pulled away from the fence wire 48 through the wire notches 12 and frame notches 2*a*, and from the fence post 49 through the frame space 2*b*.

Figure 11:
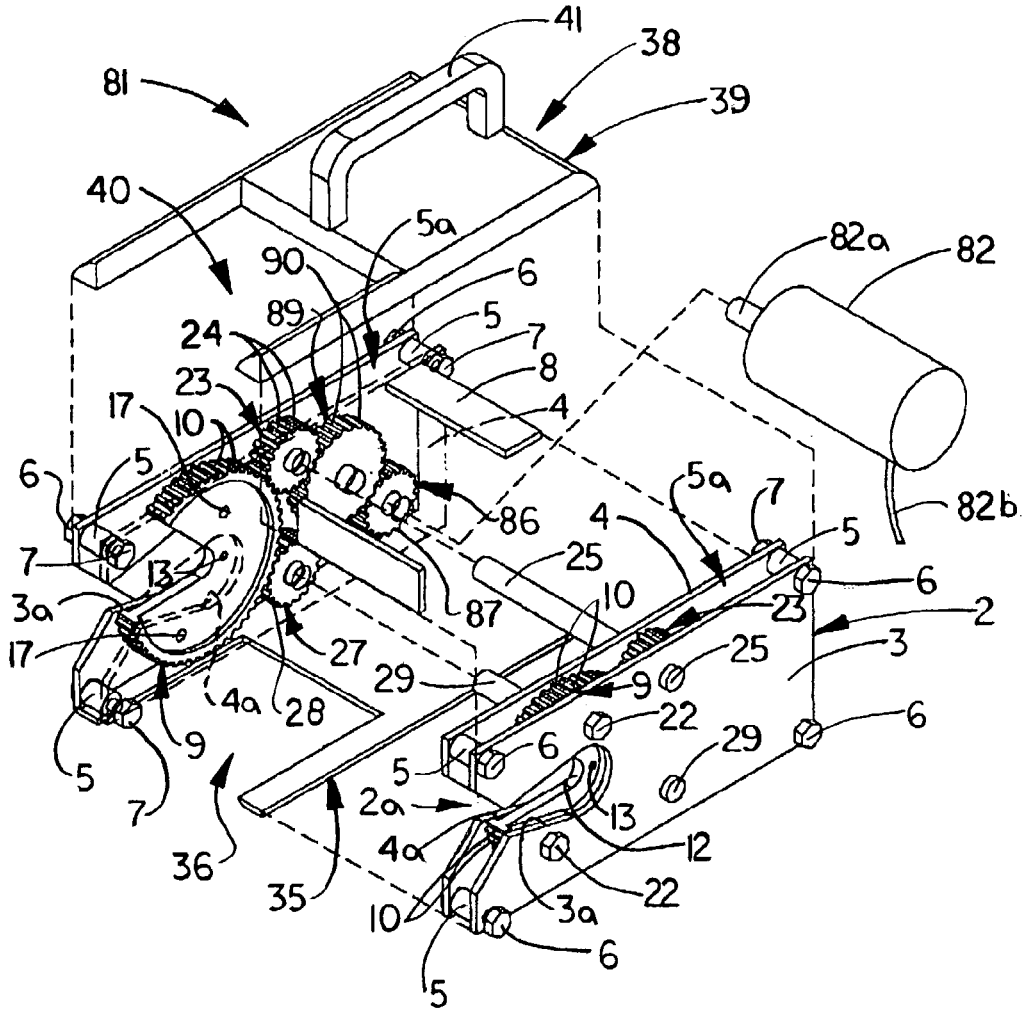
FIG. 11 is an exploded, perspective view of another embodiment of the twist attachment device, with a drive motor operably engaging a drive gear for rotating the wire twist gears of the device.

Referring next to FIG. 11 of the drawings, in another embodiment the twist attachment device of the present invention is generally indicated by reference numeral 81 and includes a typically electric drive motor 82 to which is coupled a drive shaft 82*a*. A drive gear 86 having gear teeth 87 is mounted on the drive shaft 82*a* in a plate gap 5*a* of the frame 2. A reduction gear 89 is rotatably mounted in the plate gap 5*a* on a shaft (not shown) and includes gear teeth 90 which mesh with the gear teeth 87 of the drive gear 86. A pair of upper transfer gears 23 and a pair of lower transfer gears 27 are provided on the upper transfer gear shaft 25 and on the lower transfer gear shaft 29, respectively, rotatably mounted in the frame 2, as heretofore described with respect to the twist attachment device 1 of FIGS. 1-10. Both the upper transfer gear 23 and the lower transfer gear 27 in each plate gap 5*a* mesh with the wire twist gear 9 rotatably mounted in the corresponding plate gap 5*a*, as heretofore described with respect to the twist attachment device 1. Accordingly, by operation of the drive motor 82, the drive gear 86, through the reduction gear 89, rotates both the upper transfer gear 23 and the lower transfer gear 27 in the same plate gap 5*a* of the frame 2. Thus, both of the upper transfer gears 23 and the lower transfer gears 27 are rotated on the respective upper transfer gear shaft 25 and the lower transfer gear shaft 29 and rotate the respective wire twist gears 9 in the plate gaps 5*a* on the frame 2. As heretofore described with respect to operation of the twist attachment device 1 in FIGS. 1-4 and FIGS. 8-10, the wire twist gears 9 are operable to wrap an attachment wire segment 50 around a fence wire segment 48 to secure the barbed wire segment 48 to a fence post 49, as shown in FIG. 10.

While the preferred embodiments of the invention have been described above, it will be recognized and understood that various modifications can be made to the invention and the appended claims are intended to cover all such modifications which may fall within the spirit and scope of the invention.

Having described my invention with the particularity set forth above, I claim:

1. A twist attachment device suitable for attaching a main wire to a support using an attachment wire segment, comprising:

a frame having a pair of spaced-apart inner frame plates and a pair of outer frame plates spaced from said inner frame plates, respectively, by a pair of plate gaps;

a pair of wire twist gears rotatably carried by said frame in said pair of plate gaps, respectively, said pair of wire twist gears having a pair of wire notches, respectively, for receiving the main wire and a pair of wire segment openings adjacent to said pair of wire notches, respectively, for receiving the attachment wire segment;

a housing having a top housing plate and a bottom housing plate carried by said frame and closing said pair of plate gaps; and a drive mechanism operably engaging said pair of wire twist gears for rotating said pair of wire twist gears on said frame.

2. The device of claim 1 further comprising a pair of upper transfer gears rotatably carried by said frame in said pair of plate gaps, respectively, and a pair of lower transfer gears rotatably carried by said frame in said pair of plate gaps, respectively, said pair of upper transfer gears and said pair of lower transfer gears operably engaging said pair of wire twist gears for rotating said pair of wire twist gears; and a drive gear rotatably carried by said frame in one of said pair of plate gaps for rotation by said drive mechanism, said drive gear operably engaging said pair of lower transfer gears and said pair of upper transfer gears for rotating said pair of lower transfer gears and said pair of upper transfer gears.

3. The device of claim 1 wherein said drive mechanism comprises an electric drill.

4. The device of claim 3 further comprising a pair of upper transfer gears rotatably carried by said frame in said pair of plate gaps, respectively, and a pair of lower transfer gears rotatably carried by said frame in said pair of plate gaps, respectively, said pair of upper transfer gears and said pair of lower transfer gears operably engaging said pair of wire twist gears for rotating said pair of wire twist gears; and a drive gear rotatably carried by said frame in one of said pair of plate gaps for rotation by said drive mechanism, said drive gear operably engaging said pair of lower transfer gears and said pair of upper transfer gears for rotating said pair of lower transfer gears and said pair of upper transfer gears.

5. The device of claim 1 wherein said drive mechanism comprises an electric motor.

6. The device of claim 5 further comprising a pair of upper transfer gears rotatably carried by said frame in said pair of plate gaps, respectively, and a pair of lower transfer gears rotatably carried by said frame in said pair of plate gaps, respectively, said pair of upper transfer gears and said pair of lower transfer gears operably engaging said pair of wire twist gears for rotating said pair of wire twist gears; a reduction gear rotatably mounted in one of said pair of plate gaps for rotating said pair of upper transfer gears and said pair of lower transfer gears; and a drive gear rotatably mounted in said one of said pair of plate gaps for rotation by said drive mechanism, said drive gear operably engaging said reduction gear for rotating said reduction gear.

* * * * *